US007954680B2

(12) United States Patent
Ishihara et al.

(10) Patent No.: US 7,954,680 B2
(45) Date of Patent: Jun. 7, 2011

(54) WATCH BAND WITH REINFORCED CONSTRUCTION

(75) Inventors: James A. Ishihara, Beaverton, OR (US); Jason Lane Johnson, Pflugerville, TX (US); Dexter M. Balansag, Dumaguete (HK); So Chi Chuen, Hong Kong (HK)

(73) Assignee: NIKE, Inc., Beaverton, OR (US)

( * ) Notice: Subject to any disclaimer, the term of this patent is extended or adjusted under 35 U.S.C. 154(b) by 921 days.

(21) Appl. No.: 11/681,178

(22) Filed: Mar. 1, 2007

(65) Prior Publication Data

US 2008/0210722 A1 Sep. 4, 2008

(51) Int. Cl.
*A45C 11/10* (2006.01)

(52) U.S. Cl. ..... 224/177; 24/265 WS; 368/282

(58) Field of Classification Search ..... 24/265 WS, 24/265 B, 906, 31 F, 31 H, 33 P, 33 M; 368/282; 224/164, 177, 180; 439/737
See application file for complete search history.

(56) References Cited

U.S. PATENT DOCUMENTS 2,453,993 A * 11/1948 Kreisler ..... 24/598.1
2,619,270 A * 11/1952 Foster ..... 224/168
4,432,476 A * 2/1984 Yokosuka ..... 224/164
4,624,581 A * 11/1986 Mock et al. ..... 368/282
4,861,286 A * 8/1989 Fosnaugh ..... 439/651
5,331,610 A * 7/1994 Kikuchi ..... 368/282
5,363,351 A * 11/1994 Carney ..... 368/282
5,472,037 A * 12/1995 Hoffman ..... 160/183
5,724,708 A * 3/1998 Bert ..... 24/265 B
6,415,483 B1 * 7/2002 Dang ..... 24/694
6,435,709 B2 * 8/2002 Hirano et al. ..... 368/281

* cited by examiner

*Primary Examiner* — Daniel P Stodola
*Assistant Examiner* — Rowland D Do
(74) *Attorney, Agent, or Firm* — Banner & Witcoff, Ltd.

(57) ABSTRACT

A band with a reinforced construction. The band has an attachment portion that defines a connector bar passage, a reinforcement pin passage and a reinforcement plate recess intersecting both the connector bar passage and the reinforcement pin passage. The band also has a reinforcement plate and a reinforcement pin. The reinforcement plate defines a connector bar aperture and a reinforcement pin aperture, and is positioned within the reinforcement plate recess such that the connector bar aperture intersects the connector bar passage and the reinforcement pin aperture intersects the reinforcement pin passage. Typically, the reinforcement plate is formed from a resilient material, such as metal or hard plastic. The reinforcement pin is positioned within the reinforcement pin passage such that the reinforcement pin extends through the reinforcement pin aperture of the reinforcement plate. The reinforcement plate thus reinforces the wall of material between the connector bar passage and the end of the attachment portion, and is securely held in place by the reinforcement pin.

10 Claims, 2 Drawing Sheets

WATCH BAND WITH REINFORCED CONSTRUCTION

FIELD OF THE INVENTION

The present invention relates to the reinforcement of bands. Various aspects of the invention are particularly related to the reinforcement of watch bands.

BACKGROUND OF THE INVENTION

The watch industry is continuously seeking to improve the durability of watch bands. Originally, watch bands were formed from leather or fabric. While these materials were relatively flexible and comfortable, bands made from these materials were not very durable. Exposure to water and continuous wear, for example, will quickly degrade leather and fabric watch bands. To address these deficiencies, some watch makers have created watch bands out of metal links. While metal link watch bands are more resilient than leather and fabric watch bands, they are relatively heavy and expensive.

Recently, more rugged sport watches have become popular, particularly for various activities such as running, boating, diving, and climbing. In order to keep the cost of these watches low while still providing an environment-resistant band, some watch makers have begun using watch bands formed from plastic or rubber. As shown in FIG. 1, this type of band 101 will typically have an attachment portion 103. The attachment portion 103 defines a springbar passage 105 for receiving a springbar (not shown). As known in the art, a springbar has a hollow cylinder containing two pins at either end. The pins are forced outward by a spring within the cylinder.

To attach the band to a watch, a springbar is inserted into the springbar passage 105, and the pins are pressed into the hollow cylinder. With the pins thus compressed, the attachment portion 103 is inserted between two lugs of a watch casing. Each lug contains a recess for receiving a pin. Accordingly, when the attachment portion 103 is positioned so that the springbar is aligned with the lug recesses, the spring in the springbar forces the pins into the lug recesses to secure the attachment portion 103 between the lugs.

This conventional arrangement securely attaches the watch band to the lugs of the watch casing. With this arrangement, however, the springbar passage 105 is typically formed very close to the end 107 of the attachment portion, as shown in FIG. 1. If the springbar passage 105 is formed toward the center of the attachment portion 103, then the attachment portion 103 will not be able to rotate freely about the springbar, making the band stiff and uncomfortable. When the springbar passage 105 is formed near the end 107 of the attachment portion 103, however, the relatively thin wall of material between the springbar passage 105 and the end 107 of the attachment portion 103 is prone to tearing. If this thin wall of material does tear, the springbar cannot hold the attachment portion 103 between the watch lugs.

BRIEF SUMMARY OF THE INVENTION

Aspects of the invention relate to a band with a reinforced construction. With various examples of the invention, a band will have an attachment portion that defines a connector bar passage, a reinforcement pin passage and a reinforcement plate recess intersecting both the connector bar passage and the reinforcement pin passage. The band also will have a reinforcement plate and a reinforcement pin. The reinforcement plate defines a connector bar aperture and a reinforcement pin aperture, and is positioned within the reinforcement plate recess such that the connector bar aperture intersects the connector bar passage and the reinforcement pin aperture intersects the reinforcement pin passage. Typically, the reinforcement plate is formed from a resilient material, such as metal or hard plastic. The reinforcement pin is positioned within the reinforcement pin passage such that the reinforcement pin extends through the reinforcement pin aperture of the reinforcement plate.

With these implementations of the invention, the reinforcement plate reinforces the wall of material between the connector bar passage and the end of the attachment portion. That is, when the band is pulled away from the lugs, the resilient material forming the reinforcement plate will prevent the connector bar from tearing the material between the connector bar passage and the end of the attachment portion. The reinforcement plate in turn is securely held within its recess in the attachment portion by the reinforcement pin extending through both the reinforcement plate and the reinforcement passage formed in the attachment portion.

DETAILED DESCRIPTION OF THE INVENTION

Double Reinforcement Plate Construction

Figure 1:
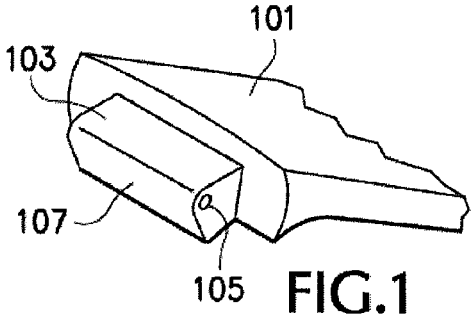
FIG.1 PRIOR ART
FIG. 1 illustrates a portion of a conventional watch band.
Figure 2:
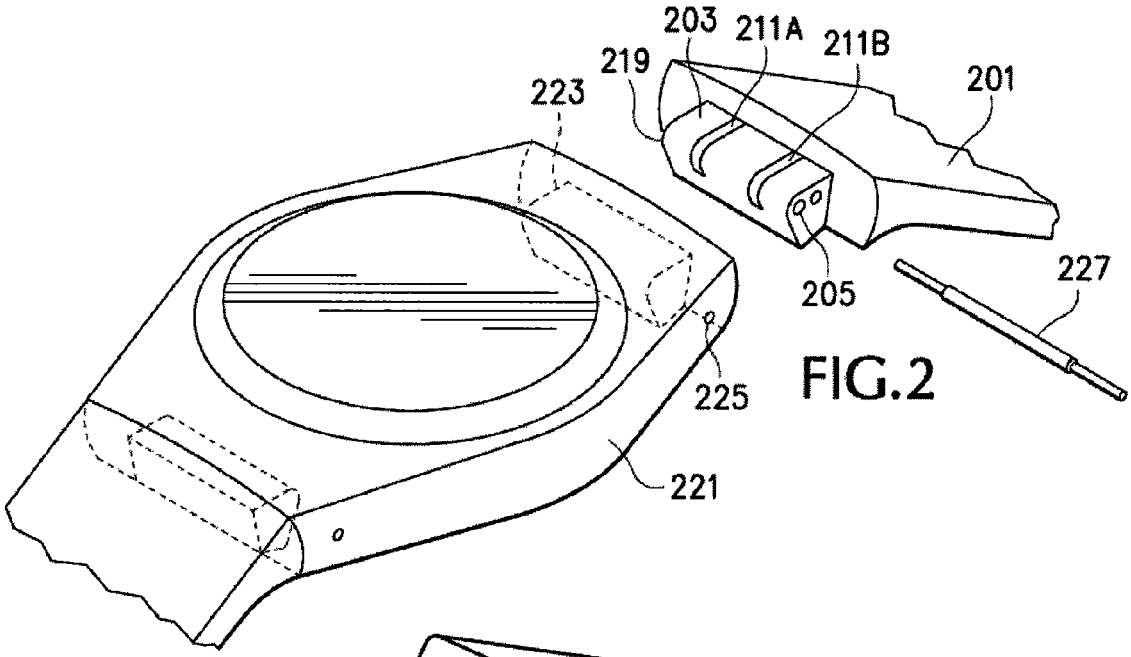
FIGS. 2 and 3 illustrate an example of a reinforced watch band construction according to various embodiments of the invention.
Figure 3:
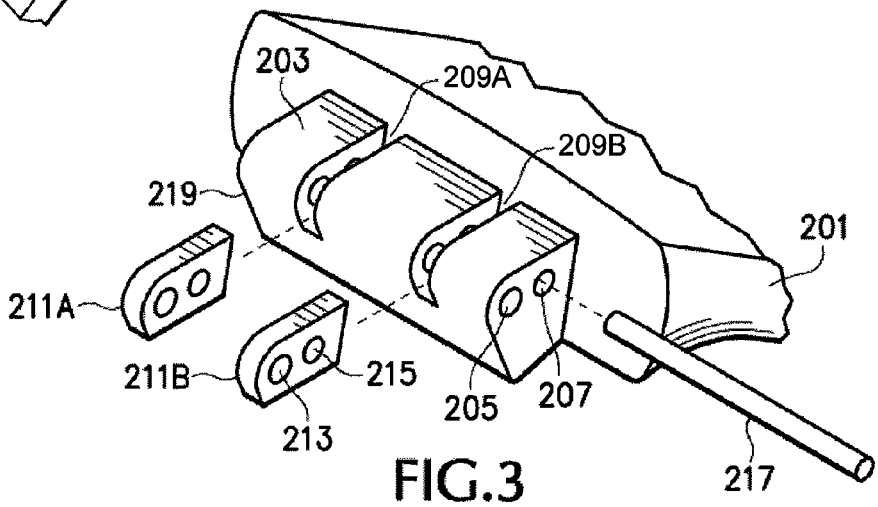

FIGS. 2 and 3 illustrate an example of a reinforced watch band construction according to various embodiments of the invention. As seen in these figures, a watch band attachment includes an attachment portion 203 integrally formed with a watch band 201. The attachment portion 203 defines a connector bar passage 205 and a reinforcement pin passage 207. It also defines two reinforcement plate recesses 209A and 209B. With various examples of the invention, the watch band 201 and the attachment portion 203 may be formed of a flexible material, such as rubber or a flexible plastic.

As also seen in these figures, the watch band attachment includes two reinforcement plates 211A and 211B. Each reinforcement plate 211 defines a connector bar aperture 213 and a reinforcement pin aperture 215. With various examples of the invention, the reinforcement plates 211A and 211B may be formed from a material that resists tearing, such as a metal, metal alloy, or a relatively hard plastic. The reinforcement plate 211A is inserted into the reinforcement plate recess 209A so that its connector bar aperture 213 intersects the connector bar passage 205 and its reinforcement pin aperture 215 intersects the reinforcement pin passage 207. Similarly, the reinforcement plate 211B is inserted into the reinforcement plate recess 209B so that its connector bar aperture 213 intersects the connector bar passage 205 and its reinforcement pin aperture 215 intersects the reinforcement pin passage 207. As shown in FIG. 3, each of the reinforcement plates 211A and 211B has a primary plane that is orthogonal to the direction of the reinforcement pin passage 207.

As a result of this configuration, when the reinforcement pin 217 is inserted into the reinforcement pin passage 207, it passes through the reinforcement pin apertures 215 of both the reinforcement plate 211A and the reinforcement plate 211B, thereby securely holding the reinforcement plates 211A and 211B in their respective reinforcement plate recesses 209A and 209B. As seen in FIGS. 2 and 3, the connector bar passage 205 is close to the side 219 of the attachment portion 203 opposite the remainder of the band (i.e., the side 219 of the attachment portion 203 that will be closest to the watch 221 when the band 201 is attached to the watch 221). The reinforcement pin passage 207, however, is positioned away from side 219 of the attachment portion 203 facing the watch 221.

Turning now to FIG. 2 in particular, the watch 221 defines a pair of band attachment recesses 223. At each band attachment recess 223, the watch 221 also defines a pair of springbar pin recesses 225. In order to attach the band 201 to the watch 221, a springbar 227 is inserted into the connector bar passage 205, so that the springbar 227 also passes through the connector bar aperture 213 of each of the reinforcement plates 211A and 211B. The pins at either end of the springbar 227 are compressed into the body of the springbar 227 in a conventional manner, and, with the springbar pins thus compressed, the attachment portion 203 is inserted into a band attachment recess 223 of the watch 221. When the attachment portion 203 is fully inserted into the band attachment recess 223, the springbar pins will expand into the springbar pin recesses 225 on either side of the band attachment recess 223. The springbar pins will thus securely hold the attachment portion 203 in the band attachment recess 223, thereby attaching the band 201 to the watch 221.

While a springbar is specifically shown in FIG. 2, it should be appreciated that other connection devices can be used with the connector bar passage 205 in alternate implementations of the invention. For example, the attachment portion 203 may be attached to the watch 221 using a bolt and cap nut. With this structure, the watch 221 will have bolt apertures in place of the springbar pin recesses 225. After the attachment portion 203 is inserted into the band attachment recess 223 so that the bolt apertures are aligned with the connector bar passage 205, the bolt is inserted into the connector bar passage 205 through one of the bolt apertures so that it passes through the connector bar aperture 213 of each of the reinforcement plates 211A and 211B and extends out of the other bolt aperture. The cap nut is then attached to the bolt to securely hold the attachment portion 203 to the watch 221. Of course, still other connection devices may be employed in similar manner, such as a double-ended bolt and cap nuts combination, rivets, etc.

As previously noted, the connector bar passage 205 is relatively close to the side 219 of the attachment portion 203 closest to the watch 221, and thus allows the attachment portion 203 the freedom of movement to rotate around the springbar 227 (or the bolt and cap nut combination) without being obstructed by the watch 221. On the other hand, the tear-resistant material of the reinforcement plates 211A and 211B reinforces the wall of material between the connector bar passage 205 and the side 219 of the attachment portion 203 closest to the watch 221. Still further, the reinforcement pin passage 207 is positioned away from the side 219 of the attachment portion 203 closest to the watch 221. As a result, when the attachment portion 203 is pulled away from the watch 221, the tear resistant material forming the reinforcement plates 211A and 211B will prevent the springbar 227 (or the bolt and cap nut combination) from tearing the softer material of the attachment portion 203 between the connector bar passage 205 and the side 219 of the attachment portion 203 facing the watch 221.

The reinforcement plates 211A and 211B in turn are securely held within the reinforcement plate recesses 209A and 209B by the reinforcement pin 217 extending through both the reinforcement plate aperture 215 and the reinforcement passage 207 formed in the attachment portion 203. Because the reinforcement pin passage 207 is relatively distant from the side 219 of the attachment portion 203 facing the watch 221, the additional material between the reinforcement pin passage 207 and the side 219 of the attachment portion 203 facing the watch 221 will be more resistant to tearing (and the resultant failure) than a conventional watch band arrangement.

Alternate Constructions

Figure 4:
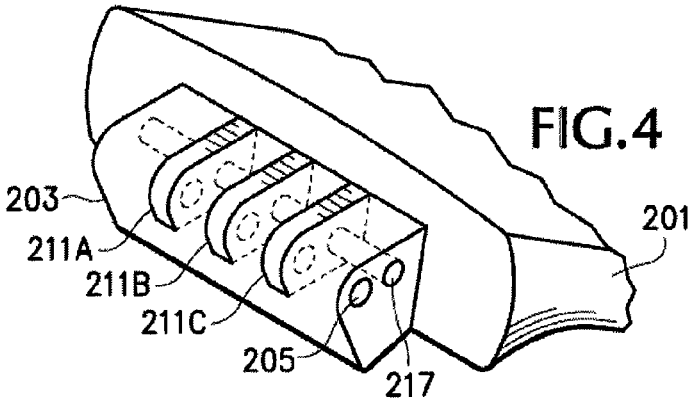
FIG. 4 illustrates another example of a reinforced watch band construction according to various embodiments of the invention.
Figure 5:
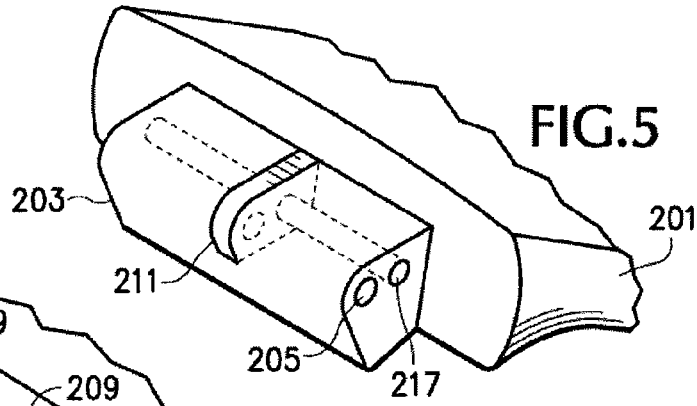
FIG. 5 illustrates yet another example of a reinforced watch band construction according to various embodiments of the invention.
Figure 6:
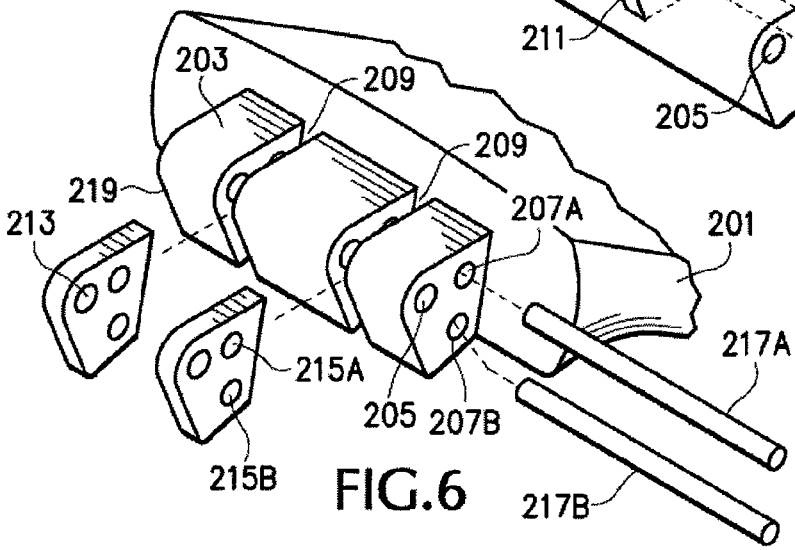
FIG. 6 illustrates still another example of a reinforced watch band construction according to various embodiments of the invention.
Figure 7:
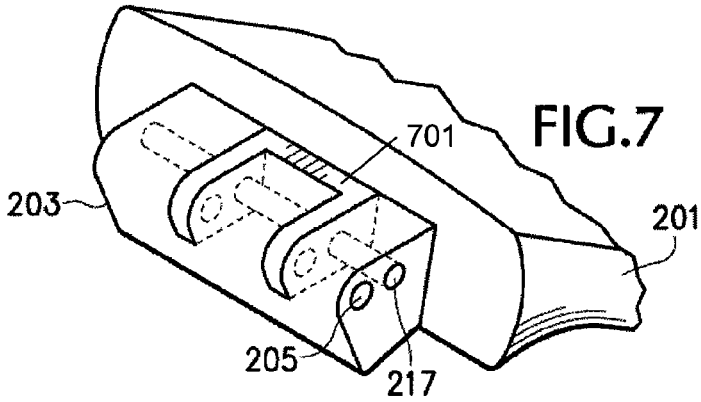
FIG. 7 illustrates still yet another example of a reinforced watch band construction according to various embodiments of the invention.

While particular examples of a reinforced watch band have been described in detail above, it will be appreciated that there are a variety of alternate constructions that can be used to implement various embodiments of the invention. For example, instead of two reinforcement plates 211, some implementations of the invention may employ three or more reinforcement plates 211 as shown in FIG. 4. Alternately, some implementations of the invention may employ only a single reinforcement plate 211 as shown in FIG. 5. Alternately or additionally, some implementations may employ two or more reinforcement pin passages 207 (with corresponding additional reinforcement pin apertures 215 in each of the reinforcement plates 211), as illustrated in FIG. 6. Still further, with some implementation, two or more of the reinforcement plates 211 may be connected by a connector 701 extending through the attachment portion 203, as illustrated in FIG. 7.

Conclusion

While the invention has been described with respect to specific examples including presently preferred modes of carrying out the invention, those skilled in the art will appreciate that there are numerous variations and permutations of the above described systems and techniques that fall within the spirit and scope of the invention as set forth in the appended claims.

What is claimed is:

1. A band attachment, comprising:

an attachment portion, the attachment portion defining:

a connector bar passage, a reinforcement pin passage substantially parallel to the connector bar passage, and at least one reinforcement plate recess intersecting both the connector bar passage and the reinforcement pin passage;

a reinforcement plate, the reinforcement plate:

defining a connector bar aperture and a reinforcement pin aperture, and being positioned within the reinforcement plate recess such that the connector bar aperture intersects the connector bar passage, and the reinforcement pin aperture intersects the reinforcement pin passage; and a reinforcement pin positioned within the reinforcement pin passage such that the reinforcement pin extends through the reinforcement pin aperture of the reinforcement plate.

2. The band attachment recited in claim 1, wherein the attachment portion defines a second reinforcement plate recess intersecting both the connector bar passage and the reinforcement pin passage; and wherein the band attachment further comprises a second reinforcement plate, the second reinforcement plate:

defining a connector bar aperture and a reinforcement pin aperture, and being positioned within the second reinforcement plate recess such that the connector bar aperture of the second reinforcement plate intersects the connector bar passage, and the reinforcement pin aperture of the second reinforcement plate intersects the reinforcement pin passage; and wherein the reinforcement pin is positioned within the reinforcement pin passage such that the reinforcement pin extends through the reinforcement pin aperture of the first reinforcement plate and through the reinforcement pin aperture of the second reinforcement plate.

3. The band attachment recited in claim 2, wherein the attachment portion further defines at least one connector passage extending between the first reinforcement plate recess and the second reinforcement plate recess; and wherein the band attachment further comprises at least one connecter extending through connector passage and connecting the first reinforcement plate to the second reinforcement plate.

4. The band attachment recited in claim 1, wherein the reinforcement plate has a primary plane substantially orthogonal to a direction of the reinforcement pin passage.

5. The band attachment recited in claim 1, wherein:

the attachment portion defines a second reinforcement pin passage substantially parallel to the connector bar passage and intersected by the at least one reinforcement plate recess, and the reinforcement plate defines a second reinforcement pin aperture intersecting the second reinforcement pin passage; and wherein the band attachment further comprises a second reinforcement pin positioned within the second reinforcement pin passage such that the second reinforcement pin extends through the second reinforcement pin aperture of the reinforcement plate.

6. The band attachment recited in claim 1, wherein the connector bar passage is defined proximal to a first side of the attachment portion, and the reinforcement pin passage is defined proximal to a second side of the attachment portion opposite the first side.

7. The band attachment recited in claim 1, wherein the attachment portion is formed of a rubber or a plastic material.

8. The band attachment recited in claim 1, wherein the reinforcement plate is formed of metal.

9. A band, comprising:

a first band portion having a first end and a second end;

a second band portion having a first end and a second end;

a first band fastener component attached to the first end of the first band portion;

a second band fastener component attached to the first end of the second band portion, the second band fastener component being complementary to the first band fastener component;

a first band attachment as recited in claim 1 attached to the second end of the first band portion; and a second band attachment as recited in claim 1 attached to the second end of the second band portion.

10. A method of forming a band attachment, comprising:

obtaining an attachment portion for a band attachment, the attachment portion defining:

a connector bar passage, a reinforcement pin passage substantially parallel to the connector bar passage, and at least one reinforcement plate recess intersecting both the connector bar passage and the reinforcement pin passage;

inserting a reinforcement plate into the at least one reinforcement plate recess, the reinforcement plate:

defining a connector bar aperture and a reinforcement pin aperture, and being positioned within the reinforcement plate recess such that the connector bar aperture intersects the connector bar passage, and the reinforcement pin aperture intersects the reinforcement pin passage; and inserting a reinforcement pin into the reinforcement pin passage such that the reinforcement pin extends through the reinforcement pin aperture of the reinforcement plate.

* * * * *